US007330095B2

(12) United States Patent
Talja et al.

(10) Patent No.: US 7,330,095 B2
(45) Date of Patent: Feb. 12, 2008

(54) COOLED MULTIPHASE CHOKE ASSEMBLY

(75) Inventors: Markku Talja, Jarvenpaa (FI); Simo Poyhonen, Vantaa (FI); Sami Vartiainen, Vantaa (FI)

(73) Assignee: ABB Oy, Helsinki (FI)

( * ) Notice: Subject to any disclaimer, the term of this patent is extended or adjusted under 35 U.S.C. 154(b) by 232 days.

(21) Appl. No.: 11/146,098

(22) Filed: Jun. 7, 2005

(65) Prior Publication Data

US 2005/0280489 A1 Dec. 22, 2005

(30) Foreign Application Priority Data

Jun. 11, 2004 (FI) ..... 20045215

(51) Int. Cl.
*H01F 30/12* (2006.01)

(52) U.S. Cl. ..... 336/5; 336/55; 336/57; 336/60

(58) Field of Classification Search ..... 336/5, 336/55, 60, 57
See application file for complete search history.

(56) References Cited

U.S. PATENT DOCUMENTS 1,746,259 A * 2/1930 Jonas ..... 363/154
4,158,123 A 6/1979 New
4,663,700 A * 5/1987 Kahkipuro ..... 363/54
5,097,241 A * 3/1992 Smith et al. ..... 336/60
5,138,294 A 8/1992 Yoshikawa

FOREIGN PATENT DOCUMENTS

| | | |
|---|---|---|
| EP | 1 037 220 A2 | 9/2000 |
| JP | 09-237 718 | 9/1997 |
| WO | 00/33331 A1 | 6/2000 |
| WO | 2004/019475 A1 | 3/2004 |

OTHER PUBLICATIONS

Finnish Office Action dated Oct. 19, 2004.

* cited by examiner

*Primary Examiner*—Elvin Enad
*Assistant Examiner*—Joselito Baisa
(74) *Attorney, Agent, or Firm*—Buchanan Ingersoll & Rooney PC

(57) ABSTRACT

A cooled multiphase choke assembly comprising a first coil (L1, L2, L3) for each phase (U, V, W) and a first cooling element (11), each first coil (L1, L2, L3) comprising several turns of winding, which define a substantially tubular tunnel inside each coil (L1, L2, L3). The first cooling element (11) extends in the tubular tunnel of each first coil (L1, L2, L3).

10 Claims, 3 Drawing Sheets

COOLED MULTIPHASE CHOKE ASSEMBLY

BACKGROUND OF THE INVENTION

The invention relates to cooled multiphase choke assemblies.

It is known to use an 'output choke' in connection with an inverter, such as an inverter of a frequency converter.

The output choke of a frequency converter limits the derivative du/dt of the output voltage of the converter and thus protects the device supplied by the frequency converter. If the device to be supplied is a motor, the output choke protects windings of the motor from partial discharges and restricts bearing currents in the motor, caused by common-mode voltage formed by pulse-shaped three-phase output voltage of the converter.

In high-current frequency converter assemblies it is known to connect switch components in parallel in order to achieve the required current strength. Thus, a frequency converter connection can comprise a plurality of output branches per each phase.

Published application WO 2004/019475 A1 "Output choke arrangement for inverter, and method in conjunction therewith" discloses an output choke assembly of an inverter, where a choke coil is provided for each branch of a phase of the inverter output. The publication discloses an assembly, in which each phase comprises three choke coils arranged symmetrically in a triangular shape, in which case the magnetic coupling between parallel branches of each phase is small and symmetrical. A structure, in which a choke coil is provided for each branch of the output, balances the currents of the switch components of the different output branches and facilitates the control of breakthroughs of the components.

The output choke assembly can be cooled in order to remove heat generated by the losses therein. It is known to position a cooling element inside a choke coil in such a manner that the flow of a coolant is guided into the choke coil from its first axial end and out of the choke coil from its other axial end. The coolant thus flows through the choke coil in the axial direction. The axial direction of the choke coil refers to a direction substantially parallel to the magnetic flux which is formed inside the choke during use.

The problem of cooled output choke assemblies is complexity. For each choke coil, there must be a cooling element with both an inlet connection and an outlet connection for the coolant. Consequently, in a three-phase inverter assembly with three output branches for each phase and one choke coil for each branch, there are eighteen coolant connections altogether. Such an assembly requires a lot of space and is complex and expensive to manufacture.

BRIEF DESCRIPTION OF THE INVENTION

It is an object of the invention to provide a choke assembly, by which the above problems can be solved. The object of the invention is achieved by a choke assembly, which is characterized in what is disclosed in the independent claim. The preferred embodiments of the invention are disclosed in the dependent claims.

The invention is based on the idea that the same cooling element passes through the first coil of each phase of the choke assembly. The advantage of the choke assembly according to the invention is its simplicity. Also, the outer dimensions of the choke assembly of the invention can be made smaller than those of the corresponding known choke assemblies.

BRIEF DESCRIPTION OF THE FIGURES

The invention will now be described in greater detail in connection with preferred embodiments, with reference to the attached drawings, in which.

DETAILED DESCRIPTION OF THE INVENTION

Figure 1:
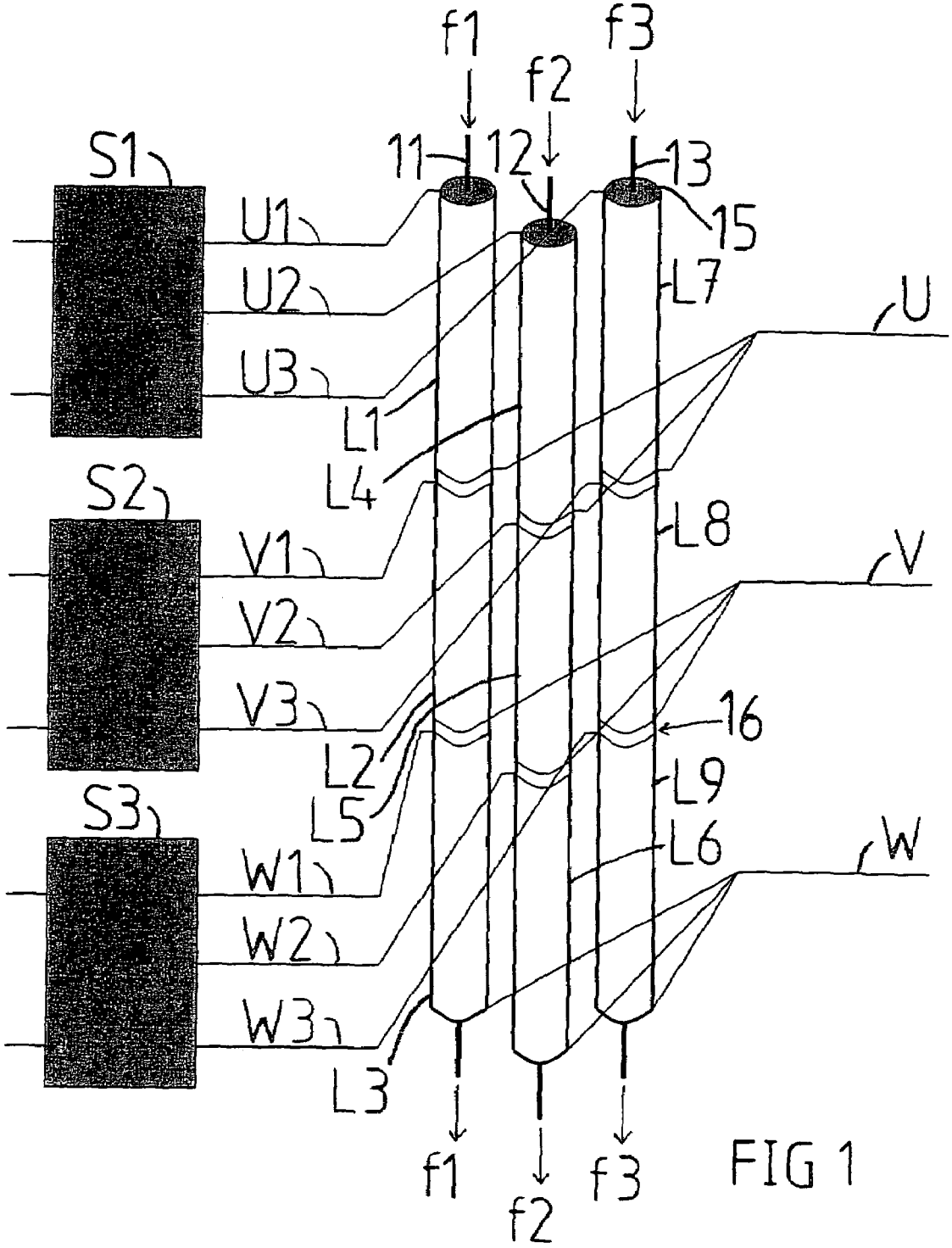
FIG. 1 shows a choke assembly according to an embodiment of the invention and switch assemblies of an inverter connected thereto.

FIG. 1 shows a cooled choke assembly according to an embodiment of the invention and connected to a three-phase inverter. Each phase of the inverter comprises a switch assembly with three output branches. Each phase of the choke assembly comprises three choke coils, i.e. the choke assembly includes nine separate choke coils altogether. The choke coils of each phase are arranged symmetrically in a triangular shape so that the centre lines of the choke coils are parallel and situated at the vertexes of an equilateral triangle.

The choke assembly also comprises a first cooling element 11, a second cooling element 12 and a third cooling element 13. Each cooling element extends linearly, and they extend parallel to each other. Around each cooling element there are three choke coils. The choke coils placed around a certain cooling element are at a predetermined axial distance from each other. Inside each coil, turns of winding define a tubular tunnel where the corresponding cooling element extends.

Around the first cooling element 11 there are a first coil L1 of a first phase U, a first coil L2 of a second phase V and a first coil L3 of a third phase W. Around the second cooling element 12 there are a second coil L4 of the first phase U, a second coil L5 of the second phase V and a second coil L6 of the third phase W. Around the third cooling element 13 there are a third coil L7 of the first phase U, a third coil L8 of the second phase V and a third coil L9 of the third phase W.

The centre lines of the choke coils positioned around a certain cooling element are on the same straight line. For instance, the centre lines of the choke coils L1, L2 and L3 are on the same straight line.

In FIG. 1 the cross-section of the choke coils is round and thus the centre lines of the choke coils are also their symmetry axes. On the basis of the above definition, the centre line of each choke coil is parallel to the axial direction of the coil.

Each cooling element 11, 12 and 13 comprises a coolant channel, in which a coolant flows when the choke assembly is used. The coolant can be liquid or gaseous.

When the choke assembly is in use, a first coolant flow f1 runs inside the first cooling element 11, a second coolant flow f2 inside the second cooling element 12 and a third coolant flow f3 inside the third cooling element 13. The coolant flow corresponding to a certain cooling element is led into this cooling element from its first axial end and out of the cooling element from its other axial end.

The coolant flow f1 of the first cooling element passes through the choke coils L1, L2 and L3. Correspondingly, the flow f2 passes through the choke coils L4, L5 and L6 and the flow f3 through the choke coils L7, L8 and L9.

The cooling elements 11, 12 and 13 are part of the cooling system of the choke assembly. Each cooling element is arranged to be connected to the other parts of the cooling system by means of a first coolant connection provided at a first axial end of the cooling element and a second coolant connection provided at a second axial end of the cooling element.

The cooled choke assembly according to FIG. 1 is arranged to be connected to the other parts of the cooling system by means of six coolant connections. In a corresponding prior art choke assembly, each choke coil requires two coolant connections, i.e. eighteen altogether.

The cooling system of the choke assembly can comprise a pump for providing coolant flow.

Inside each choke coil there is a corresponding iron-core element 15. Each iron-core element 15 is disposed around the corresponding cooling element. The iron-core elements 15 of the different choke coils are separated from each other by air gaps 16, whereby magnetic resistance between the iron-core elements 15 is high.

The first end of each choke coil is connected to the corresponding output branch of the corresponding switch assembly of the inverter. Thus, the first end of the first choke coil L1 of the first phase U is connected to a first output branch U1 of a first switch assembly S1 of the inverter, the first end of the choke coil L4 is connected to a second output branch U2 of the switch assembly S1 and the first end of the choke coil L7 is connected to a third output branch U3 of the switch assembly S1. The choke coils L2, L5 and L8 of the second phase V are similarly connected at their first ends to a first V1, second V2 and third V3 output branch of the second switch assembly S2 of the inverter, and the choke coils L3, L6 and L9 of the third phase W are similarly connected at their first ends to a first W1, second W2 and third W3 output branch of the third switch assembly S3 of the inverter.

The second ends of the choke coils of each phase are connected with each other, and thus the choke assembly only comprises one output for each phase. Consequently, the second ends of the choke coils L1, L4 and L7 of the first phase U are connected to form the output for the phase U, the second ends of the choke coils L2, L5 and L8 of the second phase V are connected to form the output for the phase V and the second ends of the choke coils L3, L6 and L9 of the third phase W are connected to form the output for the phase W.

Figure 2:
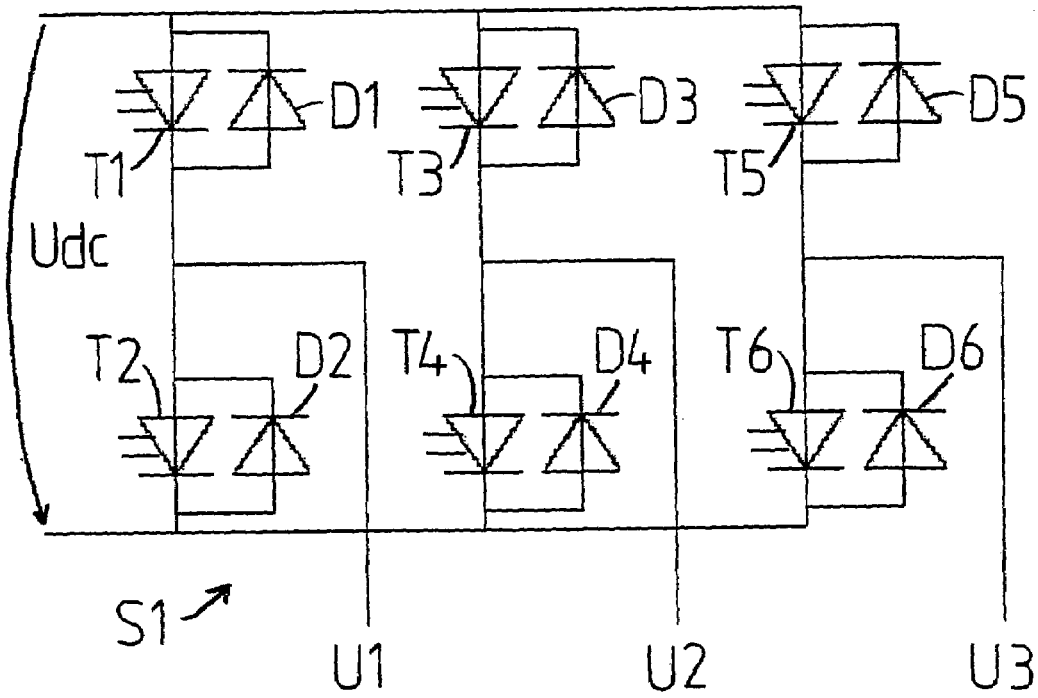
FIG. 2 shows a connection diagram of the switch assembly connected to a phase of the choke assembly of FIG. 1.

FIG. 2 shows a connection diagram of the switch assembly S1 connected to the first phase U of the choke assembly of FIG. 1. The switch assembly S1 comprises three parallel switch pairs, which are controlled simultaneously to provide a required output current. The first switch pair consists of switches T1 and T2, the second switch pair consists of switches T3 and T4 and the third switch pair consists of switches T5 and T6.

Each switch is connected in parallel with a corresponding zero diode. A zero diode D1 corresponds to the switch T1, a zero diode D2 corresponds to the switch T2, etc. The output of each switch pair at a point between the switches of the switch pair is connected to the corresponding output branch of the switch assembly. For example, the point between the switches T1 and T2 is connected to the output branch U1.

Direct-current voltage Udc is supplied to the input of the switch assembly S1, and the voltage is inverted by means of the switch components T1 to T6 in a manner fully known to a person skilled in the art. The switch components T1 to T6 can be IGBT transistors, for instance. The switch assemblies S2 and S3 have a structure similar to that of the switch assembly S1.

Figure 4:
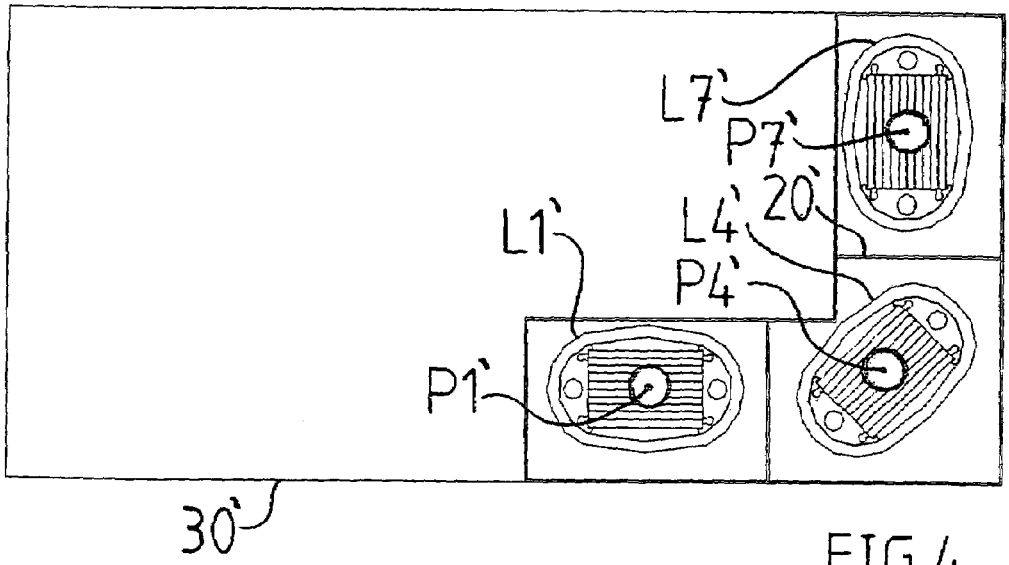
FIG. 4 shows the choke assembly of FIG. 3 in the body of a frequency converter, seen from the axial direction.
Figure 3:
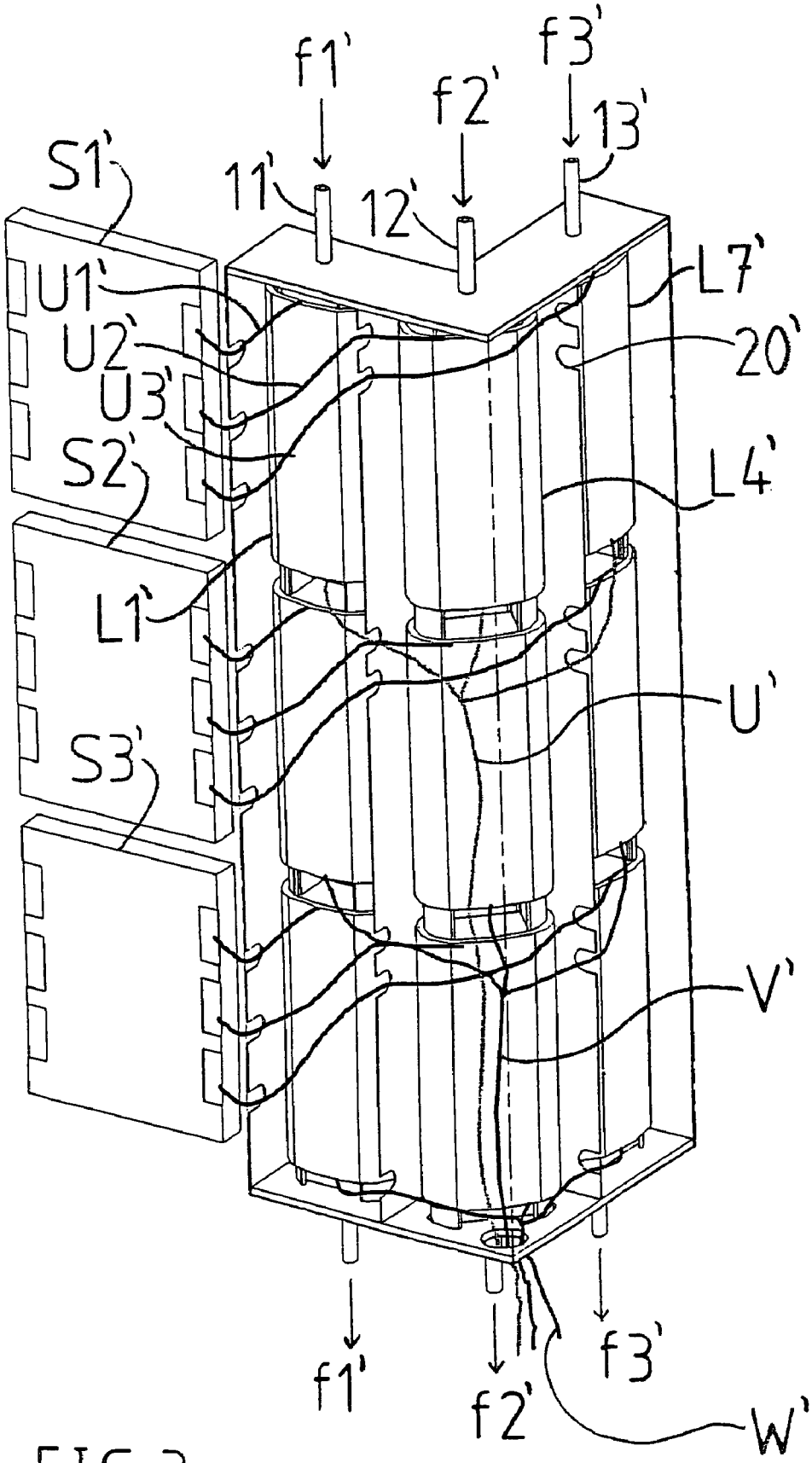
FIG. 3 shows a choke assembly according to a second embodiment of the invention and switch assemblies of an inverter connected thereto.

FIG. 3 shows a choke assembly according to an alternative embodiment of the invention, the assembly being a variation of the choke assembly of FIG. 1. FIG. 4 shows the choke assembly of FIG. 3 positioned in a body of a frequency converter and seen from the axial direction. The same reference numbers are used for the components of FIGS. 3 and 4 as for the corresponding components of FIGS. 1 and 2, yet so that the reference numbers of FIGS. 3 and 4 are provided with apostrophes. In connection with FIGS. 3 and 4, only those features that differ from the features of the embodiment of FIGS. 1 and 2 or that are not described in the above will be explained herein.

The choke assembly of FIG. 3 differs from the assembly of FIG. 1 with regard to the positioning of the choke coils. In addition, the choke assembly of FIG. 3 comprises a partitioning wall element 20'. As to the other parts, the structure of the choke assembly of FIG. 3 substantially corresponds to the structure of the choke assembly of FIG. 1.

FIG. 4 shows the positions of choke coils L1', L4' and L7' of output branches U1', U2' and U3' of a first switch assembly S1' inside the body 30' of a frequency converter, seen from the axial direction. For the sake of clarity, the body 30' of the frequency converter is illustrated by a line having a form of a rectangular parallelogram.

The midpoints of the choke coils L1', L4' and L7' are denoted by reference numbers P1', P4' and P7'. The centre line of each choke coil passes through its midpoint. The choke coils L1', L4' and L7' are arranged substantially in the L form so that their midpoints P1', P4' and P7' are at the vertexes of such an isosceles triangle the apex angle of which is 100°. At the vertex corresponding to the apex angle of said isosceles triangle there is the midpoint P4' of the choke coil L4' and thus the choke coil L4' is called the middle choke coil in this context.

The middle choke coil L4' is at a corner of the body 30', and the outermost choke coils L1' and L7' are situated next to it in such a manner that the distance between the points P1' and P4' is as great as the distance between the points P7' and P4'. The cross-sections of the choke coils L1', L4' and L7' are substantially elliptical such that the semi-axes of each ellipse begin at the midpoint of the corresponding choke coil.

Each outermost choke coil is positioned so that the major axis of the corresponding ellipse is parallel to the wall of the body 30' next to the choke coil. The middle choke coil L4' is positioned so that the major axis of the corresponding ellipse is at an equal angle both with the major axis of the ellipse corresponding to the choke coil L1' and with the major axis of the ellipse corresponding to the choke coil L7'.

As to space utilization, a choke assembly, in which the choke coils of the output branches of each switch assembly S1' to S3' are arranged in the L form, is more efficient than a choke assembly in which the choke coils are arranged in the shape of an equilateral triangle. The shape of an equilateral triangle produces an indefinite waste space around it, the utilization of which is difficult, whereas the L form produces a substantially smaller waste space. The outer dimensions of a frequency converter, the choke coils of which are arranged in the L form, can thus be made smaller than a frequency converter, the choke coils of which have the shape of an equilateral triangle.

A choke assembly, in which the choke coils of the output branches of each switch assembly are arranged in the L form, is not completely symmetrical, i.e. the magnetic effects do not compensate for each other entirely. In many cases, the spatial advantages achieved with the L form are much more valuable than the small magnetic asymmetry caused by the L form.

If required, interference of a choke assembly utilizing the L form can be reduced by partitioning the branch-specific chokes. In FIGS. 3 and 4, the branch-specific chokes are separated from each other by the partitioning wall element 20'. The partitioning wall element 20' is arranged to separate the choke coils positioned around each cooling element magnetically from the choke coils positioned around other cooling elements. The partitioning wall element 20' thus extends between e.g. the choke coils L1' and L4' and between the choke coils L4' and L7'. Due to the partitioning wall element 20', the magnetic coupling between the parallel branches of each phase is very small.

The partitioning wall element 20' is arranged to break the magnetic flux between the choke coils on its different sides, i.e. to reduce mutual inductance of the choke coils. The partitioning wall element 20' can be made of a steel sheet, for instance.

The choke coils can also be arranged in the L form in a manner different from that of FIGS. 3 and 4. For instance, the midpoints of the choke coils can be located at the vertexes of such an isosceles triangle the apex angle of which is 80° to 105°. The angle between the major axis of the ellipse corresponding to the middle choke coil and the major axis of the ellipse corresponding to the first outermost choke coil can be different from the angle between the major axis of the ellipse corresponding to the middle choke coil and the major axis of the ellipse corresponding to the second outermost choke coil, whereby the major axis of the ellipse corresponding to the middle choke coil can be located, for instance, on the same straight line as the major axis of the ellipse corresponding to either of the outermost choke coils. The triangle, at whose vertexes the midpoints of the choke coils are located, need not necessarily be an isosceles triangle. The cross section of the choke coils arranged in the L form need not be elliptical but it can be, for instance, round, like in the embodiment of FIG. 1.

The invention is described above in association with three-phase choke assemblies comprising three choke coils for each phase. However, it is obvious that the invention can also be applied in situations where the number of phases of the choke assembly or the number of choke coils per each phase differs from three.

It is obvious to a person skilled in the art that the basic idea of the invention can be implemented in various ways. The invention and the embodiments thereof are thus not restricted to the above examples but may vary within the scope of the claims.

The invention claimed is:

1. A cooled multiphase choke assembly comprising:

a first coil, a second coil and a third coil for each phase, each first coil, second coil and third coil comprising several turns of winding in such a manner that the turns of winding define a substantially tubular tunnel inside each first coil, second coil and third coil, respectively; and a first cooling element, a second cooling element and a third cooling element, the first cooling element, the second cooling element and the third cooling element each having a coolant channel arranged to receive a flowing coolant, wherein the first cooling element extends in the tubular tunnel of each first coil, the second cooling element extends in the tubular tunnel of each second coil, and the third cooling element extends in the tubular tunnel of each third coil in such a manner that, when the assembly is in use, the same first coolant flow runs inside each first coil, the same second coolant flow runs inside each second coil and same third coolant flow runs inside each third coil, and wherein the first cooling element, the second cooling element and the third cooling element extend substantially linearly, whereby the center lines of the first coils are substantially on the same straight line, the center lines of the second coils are substantially on the same straight line, and the center lines of the third coils are substantially on the same straight line.

2. A choke assembly as claimed in claim 1, wherein the first cooling element, the second cooling element and the third cooling element are arranged to comprise only two coolant connections each.

3. A choke assembly as claimed in claim 1, wherein the first, the second and the third coil of each phase are arranged symmetrically so that their center lines are parallel and are located at the vertexes of an equilateral triangle.

4. A choke assembly as claimed in claim 1, wherein the first, the second and the third coil of each phase are arranged in such a manner that their center lines are parallel and substantially in a L-form.

5. A choke assembly as claimed in claim 4, wherein the first, the second and the third coil of each phase are arranged in such a manner that their midpoints are at the vertexes of an isosceles triangle.

6. A choke assembly as claimed in claim 5, wherein the apex angle of said isosceles triangle ranging from 80° to 105°.

7. A choke assembly as claimed in claim 4, wherein the cross section of each choke coil is substantially elliptical.

8. A choke assembly as claimed in claim 4, wherein the choke assembly also comprises partitioning means arranged to partition the choke coils of the parallel branches of each phase in such a manner that the magnetic coupling between the parallel branches of each phase becomes smaller.

9. A choke assembly as claimed in claim 1, wherein the second ends of the coils of each phase are connected with each other, whereby the choke assembly only comprises one output for each phase.

10. A choke assembly as claimed in claim 1, wherein the choke assembly is a three-phase assembly.

* * * * *